United States Patent [19]

Favre-Tissot

[11] Patent Number: 4,587,728

[45] Date of Patent: May 13, 1986

[54] METHOD OF PRODUCING AN ELECTRICAL CONTACT MEMBER

[75] Inventor: Jean-Paul Favre-Tissot, Brignoud, France

[73] Assignee: Merlin Gerin, Grenoble, France

[21] Appl. No.: 578,083

[22] Filed: Feb. 8, 1984

[30] Foreign Application Priority Data

Feb. 21, 1983 [FR] France ..... 83 03051

[51] Int. Cl.[4] ..... H01R 43/02

[52] U.S. Cl. ..... 29/879; 29/882; 219/118

[58] Field of Search ..... 29/882, 878, 879; 219/85 R, 118; 228/265

[56] References Cited

U.S. PATENT DOCUMENTS

| | | | |
|---|---|---|---|
| 2,216,510 | 10/1940 | Burns | 29/879 |
| 2,513,939 | 7/1950 | Hoern | 228/269 X |
| 3,139,669 | 7/1964 | Gwyn, Jr. | 29/879 |
| 3,191,276 | 6/1965 | Gwyn, Jr. | 29/882 |
| 3,605,262 | 9/1971 | Shibata | 29/882 X |
| 4,107,506 | 8/1978 | Pelegri | 219/85 R X |
| 4,291,215 | 9/1981 | Bennett et al. | 219/118 |
| 4,364,173 | 12/1982 | Broadhurst | 29/882 |
| 4,429,458 | 2/1984 | Shibata | 29/879 |

FOREIGN PATENT DOCUMENTS

| | | |
|---|---|---|
| 2641508 | 2/1978 | Fed. Rep. of Germany . |
| 2484136 | 12/1981 | France . |

*Primary Examiner*—Howard N. Goldberg
*Assistant Examiner*—Carl J. Arbes
*Attorney, Agent, or Firm*—Parkhurst & Oliff

[57] ABSTRACT

A coating in the form of a silver-based foil or strip is fixed onto a protuberance of a contact finger by resistance brazing while applying a force to crush the protuberance which constitutes the foundation of the strip.

5 Claims, 15 Drawing Figures

METHOD OF PRODUCING AN ELECTRICAL CONTACT MEMBER

BACKGROUND OF THE INVENTION

1. Field of the invention

The invention relates to a manufacturing process for an electrical contact part comprising a contact finger made of highly conductive material, particularly copper, onto which a coating in the form of a silver-based foil or strip constituting the contact is fixed by brazing or welding.

2. Description of the Prior Art

The choice of materials and of the surface of an electrical contact, particularly a switchgear contact, depends on many factors, and in particular on the resistivity of the contact material, the mechanical resistance and the arc-resistance of the contact, a contact pad of the kind mentioned, produced by welding a silver or silver alloy pellet onto a copper body enables these imperative requirements to be taken into account. The pellet, made for example of a silver-nickel alloy, is relatively thick, and its surface presents the definitive shape of the contact, for example curved or cylindrical. The body, in this case the contact finger, presents a foundation onto which the pellet is welded, notably by high frequency welding. The pellet and body keep their initial shape, the weld merely creating a simple bond therebetween.

This known process for producing a contact is costly for it necessitates a large amount of silver, which is a precious metal, and a relatively long welding or brazing time. Moreover, the whole end of the contact finger is subjected to annealing which affects its properties.

SUMMARY OF THE INVENTION

According to the invention, the contact finger has a protuberance, in the contact area, on which said coating is deposited before bringing the end of a welding electrode onto the coating and applying a resistance welding current while exerting a compression force to crush said protuberance and fix said coating on the crushed protuberance.

A single operation produces, by hot crushing of the protuberance, an enlarged foundation for the coating to fix the latter onto this foundation. By using an electrode with a die-shaped end surface, the protuberance and its coating are moulded to the required shape during the welding operation, the deformation of the copper body being contained by the die. An examination of the finished part shows an annealed area, limited to the protuberance, resistance heating being localized in this area.

The process according to the invention can be used for a thin silver foil coating, for example a few hundredths of a millimeter thick, welding being carried out directly on the copper body, which constitutes the contact finger, without a brazing deposit.

Some applications necessitate thicker coatings obtained by brazing a strip one or several millimeters thick. The strip material is generally a silver-nickel, silver-tungsten, silver-graphite or similar alloy, commonly used for contact pellets, a foil or past braze being applied to the protuberance before depositing the strip. A phosphorus braze gives good results even for the silver-nickel strips, which is unexpected. The crystallographic examination shows a real incrustation of the strip onto the body with a close bond between the two materials ensuring good conduction. The plain-faced strip is shaped and curved to present a convex contact free during welding.

The resistance welding or brazing operation is very short, in the order of one second, which explains the limited annealing of the pad, only the upper layer of the protuberance and of the finger being heated by Joule effect. The intensity of the heating current is advantageously comprised within the range of 15,000 to 50,000 amperes. As an example, it is specified that a silver and nickel alloy strip 1.5 mm thick can be brazed with a phosphorous solder one mm thick by a welding current of 20,000 amperes for a duration of one second, the force applied to the electrode being 500 Decanewtons. This force must of course be adapted to the size of the contact pad and varies to a large extent.

According to a development of the invention, the contact finger is cut out of a copper plate, the protuberance appearing on the outline of the finger. The coating is applied by the previously mentioned process to the section of the protuberance, the latter broadening out during the welding operation to constitute an enlarged support foundation for the contact proper. An almost complete crushing of the protuberance limits the contact protrusion height to that of the strip shaped by the electrode die.

It was established that the process in accordance with the invention enables thin coatings to be used, which is explained by the enlarged support and the close bond between the coating and its support. This results in an appreciable saving in material, particularly silver.

The invention also relates to a contact pad with a thin silver-based coating resistance welded or brazed onto a hot crushed protuberance of a copper contact finger. This contact pad advantageously replaces conventional silver pellet based contacts, commonly used in low voltage equipment. It can operate in combination with a contact of the same type or of a different type according to the characteristics required.

In a preferential application, the contact according to the invention constitutes the movable contact of a switchgear apparatus, particularly a low voltage circuit-breaker. The contact in accordance with the invention increases the performances of the equipment, particularly breaking.

Manufacturing does not necessitate any special machine, as adapting the electrode of a standard resistance welding machine and providing a device applying a force on the electrode is sufficient. The reduction in welding time results in a higher production rate and a considerable reduction in cost. The assembly process can be automated.

According to another development of the invention, the contact pad comprises several fingers side by side joined together by welding a strip in accordance with the invention process covering the whole of the protuberances. A bond is observed between the copper fingers, brought about by hot crushing of the protuberances.

The electrode is preferably tungsten and presents a die in the shape of a concave-bottomed groove, the shape of the bottom being complementary to that of the convex surface of the contact. The depth of the groove enables the coating and protuberance to be confined so as to achieve a true hot casting. Localized resistance heating facilitates this superficial casting and the width of the groove defines that of the foundation obtained by crushing of the protuberance. The width of the strip is roughly equal to that of the groove, the strip merely being deformed or curved to present a convex contact surface. In the case of a small thickness coating, in particular silver foil, the edges of the foil can be folded over to form a cap covering the crushed protuberance.

BRIEF DESCRIPTION OF THE DRAWINGS /

Other advantages and characteristics will become more clearly apparent from the description that follows of the different modes of implementation of the invention, given as non-exhaustive examples and represented in the accompanying drawings, in which.

DESCRIPTION OF THE PREFERRED EMBODIMENT

Figure 1:
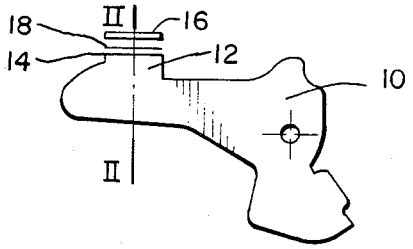
FIG. 1 is an elevational view of a contact pad prior to the brazing operation according to the invention.
Figure 2:
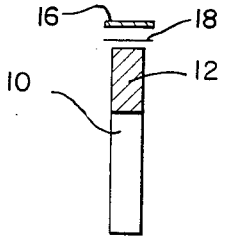
FIG. 2 is a sectional view taken along the line II—II in FIG. 1.
Figure 3:
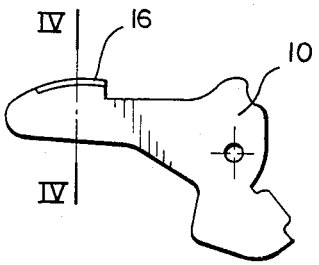
FIGS. 3 and 4 are elevtional and sectional views similar to FIGS. 1 and 2 respectively of the pad after the brazing operation.
Figure 4:
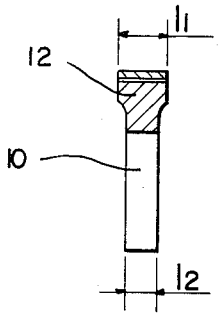
Figure 5:
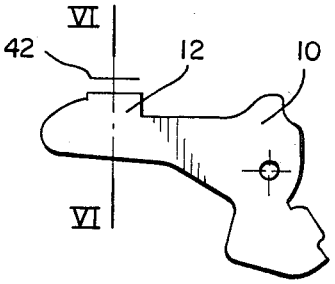
FIGS. 5 to 8 are similar views to FIGS. 1 to 4, representing another embodiment according to the invention.
Figure 6:
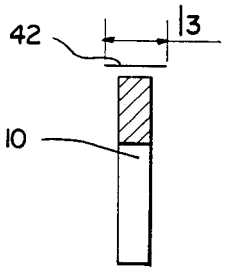
Figure 7:
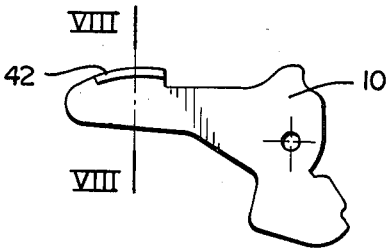
Figure 8:
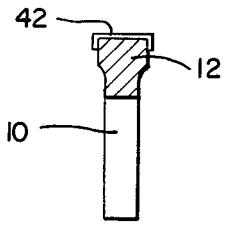
Figure 10:
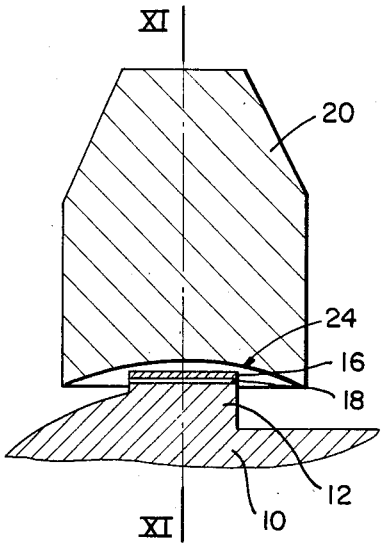
FIG. 10 is a sectional view taken along the line X—X of FIG. 11, showing the brazing electrode and the contact pad prior to the brazing operation.
Figure 11:
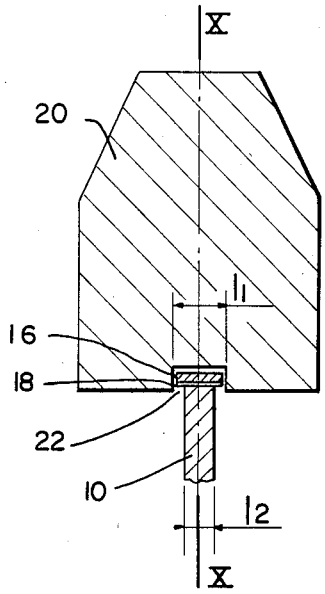
FIG. 11 is a sectional view taken along the line XI—XI of FIG. 10.
Figure 12:
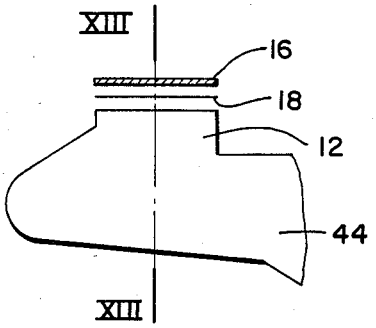
FIGS. 12 to 15 are similar views to FIGS. 1 to 4, illustrating another embodiment according to the invention.
Figure 13:
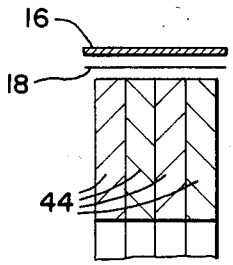
Figure 14:
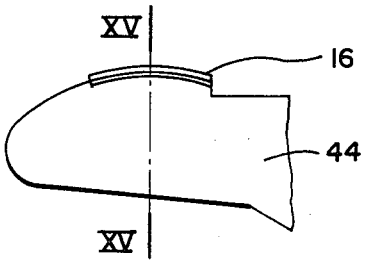
Figure 15:
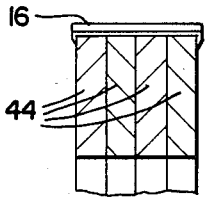

In the figures, a contact pad 10, for example a movable contact of a current breaking device, is cut out of a copper plate or any other highly conductive material, following a predetermined outline. In the example illustrated by the figures, the width of the contact pad, in this case the thickness of the copper plate, is small, for example 3 mm, but it is clear that the invention can be applied to wider or narrower contacts according to the applications and characteristics of the equipment of which the contact forms a part. The outline of contact pad 10 presents a protuberance 12 the edge 14 of which is intended to be covered with a silver-based coating to constitute the contact proper. In the example according to FIGS. 1 to 4, the coating is constituted by a straight parallelepipedal-shaped strip 16 made of a silver alloy, notably silver-nickel, silver-graphite or silver-tungsten. A braze is interposed between the edge 14 and strip 16, notably a phosphorus solder foil 18, one tenth of a millimeter thick for example, prior to application of a resistance brazing electrode 20 (FIGS. 10 and 11). Electrode 20 is applied with a predetermined force to strip 16 and protuberance 12 for the time the brazing current passes. The combined action of heating by Joule effect and of compression by the force exerted by electrode 20 on protuberance 12 causes crushing of the latter and a brazing deformation of strip 16. The end of electrode 20, acting in conjunction with strip 16, is contact casting die-shaped. In FIGS. 10 and 11, it can be seen that this die is made up of a convex-bottomed groove 22 capable of covering strip 16 and protuberance 12. The width $l_1$ of groove 22 is greated than the width $l_2$ of the pad or of contact finger 10, this width $l_1$ corresponding to that of protuberance 12 crushed after the brazing operation (see FIG. 4). The width of strip 16 and of brazing foil 18 is equal to or slightly less than the width $l_1$ of groove 22 so that it can fit in the latter when brazing electrode 20 is lowered. Prior to the brazing operation, strip 16 and solder 18 extend laterally beyond protuberance 12, their lengths on the other hand being appreciably equal. Referring in particular to FIGS. 3 and 4, which represent the finished contact pad, it can be seen that the contact constituted by strip 16 is fixed on an enlarged foundation constituted by crushed protuberance 12. Strip 16 has been shaped to present a convex surface complementary to surface 24 of die 22.

As an example, it is specified that the contact according to FIGS. 3 and 4 of a width $l_2$ of 3 mm was produced using a silver-nickel alloy strip 16. The thickness of the strip 16 is 1.5 mm, its width $l_1$ being 5 mm and its length 9 mm. The thickness of the phosphorus brazing foil 18 is one tenth of a millimeter, the width and length being respectively 5 and 8 mm. The width $l_1$ of groove 22 of electrode 20 is also 5 mm and the force of applicaton is 500Decanewtons. The resistance welding current is maintained for approximately one second, the current intensity being 20,000 amperes. It is obvious that these figures have to be adapted to the dimensions of contact pad 10, in particular the force application can vary to a large extent depending on the type of contact produced. The brazing current is generally in the range of 15,000 to 50,000 amperes, the time this current is maintained being generally in the order of one second.

Protuberance 12 does not necessarily have to be disposed on contact pad 10 periphery, but can be present on a flat surface, for example of a fixed contact or on any other part of this contact. The edge 14 receiving strip 16 does not necessarily have to be flat and this strip 16 can also be of a different shape.

Figure 9:
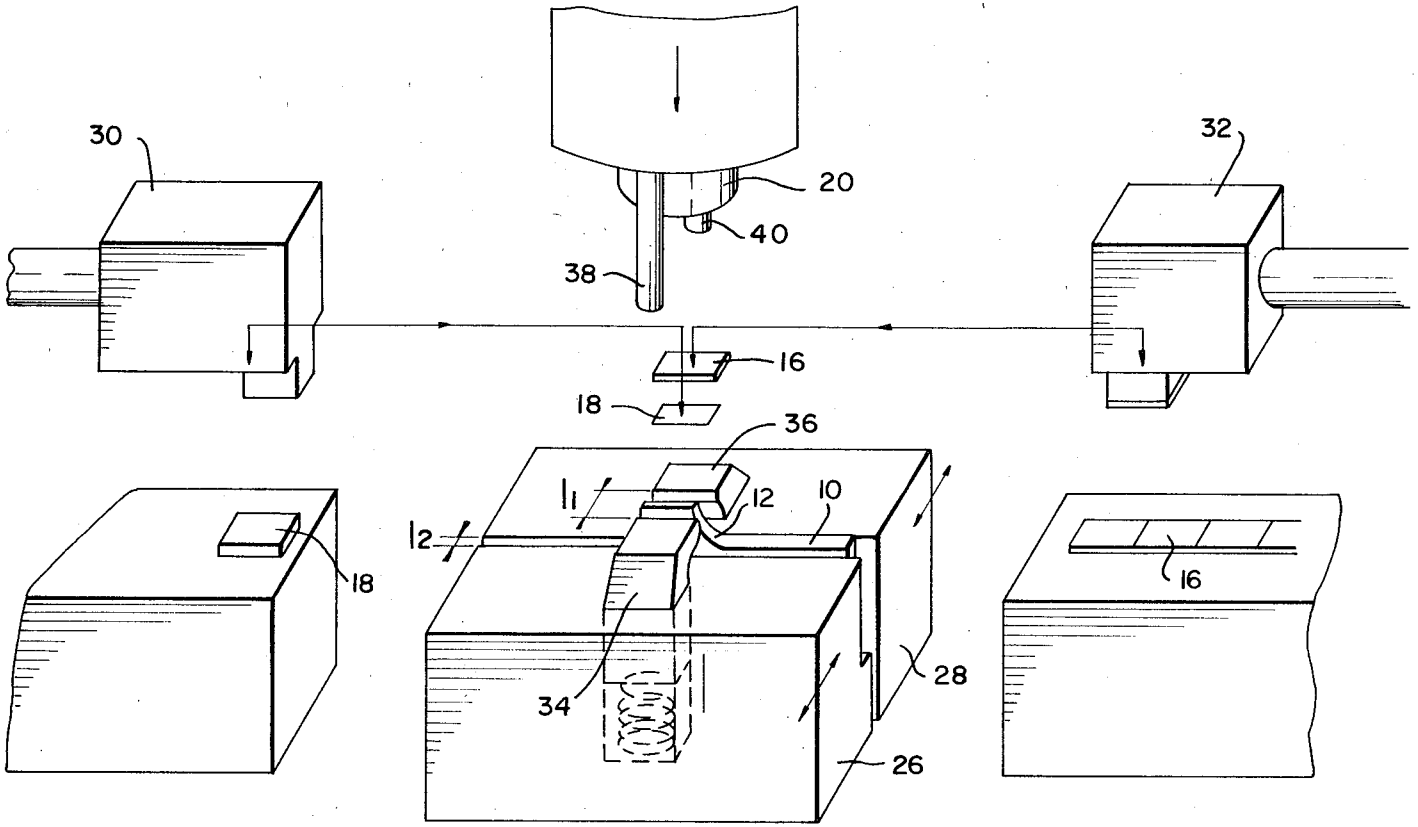
FIG. 9 is a diagrammatic perspective view of a machine to implement the process according to the invention.

The process according to the invention is summed up hereafter by describing the operation of the welding machine illustrated in FIG. 9. Contact finger 10 is clamped between the jaws 26, 28 of a vice, with protuberance 12 facing in the direction of a soldering electrode 20. A transfer device, shown by the general reference 30, picks brazing foil 18 up and deposits it on edge 14 of protuberance 12. The next operation, carried out by a transfer device 32, consists of depositing strip 16 on foil 18. Each jaw 26, 28 is fitted with an arm 34, 36 holding foil 18 and strip 16. These retaining arms 34, 36 encompass protuberance 12 laterally being at a distance $l_1$ from the latter corresponding to the width of foil 18 and of strip 16. When electrode 20 is lowered, push-rods 38, 40 push retaining arms 34, 36 back, groove 22 of electrode 20 fitting over strip 16. After a clamping force, for example 500 DecaNewtons, has been applied, a brazing current of approximately 20,000 amperes is applied for one second. After electrode 20 has been raised, pad 10 is released by unclamping of jaws 26, 28, the machine being ready for the next operation. Assembly can be automated and the cycle length, essentially determined by the brazing time, is significantly lower than that required by high-frequencey brazing. Copper pad 10 does not require any pickling and can be brought rough from cutting carried out on another piece of equipment. It is pointless describing this machine in detail, the various elements being well-known in themselves, particularly transfer devices 30, 32 and welding electrode 20. The force can be applied by any suitable means, notably by a jack (not shown).

The process according to the invention can be applied to a contact having a coating of small thickness constituted by a pure silver foil. Figures 5 to 8 illustrate a contact of this kind in which the foil 42 is deposited directly on the protuberance 12 without any interposition of braze. The width $l_3$ of foil 42 is significantly greater than that of contact finger 10, in order to cause the edges to fold over to constitute a cap covering crushed protuberance 12, when electrode 20 is lowered. The welding machine and the cycle are identical to that described above, only the brazing foil deposit phase being abolished. The thickness of foil 42 is a few hundredths or thousandths of a millimeter, crushed protuberance 12 being entirely covered by this foil 42. It is clear that the invention can be applied to a foil 42 the edges of which are not folded over the sides of crushed protuberance 12. The enlarged foundation constituted by crushed protuberance 12 enables this reduction to be made in the silver-based coating.

Referring to FIGS. 12 to 15, another embodiment according to the invention can be seen, in which the contact pad is made up of four fingers 44 side by side, each one presenting a protuberance 12. A brazing foil 18 and a single strip 16 of suitable dimensions are deposited on the four protuberances 12 side by side to carry out a brazing operation described in reference to FIGS. 1 to 4 above. The protuberances 12 are crushed and shaped by the action of the heating and of the compression exerted by electrode 20 to form the contact surface for strip 16. The four fingers 44 are joined on the one hand by strip 16 brazed onto protuberances 12, and on the other hand by crushing and melting of the copper in protuberances 12. The few examples described above show that the invention can be applied to different types of contact, in particular those having variable shapes and sizes. The contact pad can be made of copper or a copper alloy or if need by of another highly electrically conductive material, and the make-up and shape of the coating can be different. The breaking capacity of equipment fitted with contacts according to the present invention is significantly higher than that of equipment with contacts fitted with pads 2.5 mm thick. To the reduction in manufacturing costs, notably the amount of silver required to produce these contacts, should be added the increase in performance of the equipment. Resistance welding or brazing produces a close bond that limits the temperature rise when current passes through the electrical equipment. Another important advantage of resistance welding is that it limits the temperature rise in the protuberance area thus avoiding any annealing of the support part. The contact produced in accordance with the invention process does not require any subsequent treatment, in particular cleaning of machining.

What is claimed is:

1. A method for producing an electrical contact member having a contact finger made of a highly conductive material and a contact having a contact base and a contact surface, said contact surface being made from a material comprising silver and covering the contact base, said method comprising the steps of:

cutting said contact finger made from a metal plate of highly conductive material and forming said contact finger with a protuberance on its edge for forming said contact base, the width of said metal plate being smaller than the width of said contact surface;

locating a resistance welding electrode at a spaced distance from said protuberance, said electrode having a die-shaped end surface, and rigidly clamping said contact finger for forming with said electrode pair of welding electrodes;

placing a silver-based foil between said protuberance and said die-shaped end surface for forming said contact surface, the width of said foil being greater than that of said metal plate so that the foil extends laterally and symmetrically over the protuberance; and applying a compressive force to force said welding electrode onto said foil and protuberence, and simultaneously applying a resistance welding current so as to heat and laterally deform said protuberance into the width of said foil and shape of said die and thereby fix said foil onto the expanded protuberance.

2. The method according to claim 1 further comprising the step of interposing a phosphorus braze between the protuberance and said silver foil before applying the compressive force to force welding electrode onto said foil and proterberance.

3. The method according to claim 1, wherein the step of placing a silver based foil includes placing a silver-based foil of a width greater than the width of said contact base onto said protuberance so that the die-shaped electrode folds the edges of said foil when the compression force is applied to produce a cap covering the expanded protuberance.

4. The method according to claim 1, wherein the resistance welding current is in the range of 15,000 to 50,000 amperes and is applied for approximately one second.

5. A method according to claim 1, wherein the thickness of said silver-based foil is in the range of a few thousandths to a few hundredths of a millimeter.

* * * * *